US005520717A

United States Patent [19]

Miller et al.

[11] Patent Number: 5,520,717

[45] Date of Patent: May 28, 1996

[54] ISOLATING NANOPHASE AMORPHOUS MAGNETIC METALS

[75] Inventors: Robert J. Miller, Fall City; Diane C. Rawlings, Bellevue; Larry K. Olli, Seattle, all of Wash.

[73] Assignee: The Boeing Company, Seattle, Wash.

[21] Appl. No.: 476,973

[22] Filed: Jun. 7, 1995

[51] Int. Cl.[6] ..... B22F 9/16

[52] U.S. Cl. ..... 75/345; 75/348; 75/362; 148/105

[58] Field of Search ..... 75/345, 348, 362; 148/105

[56] References Cited

U.S. PATENT DOCUMENTS

| | | | |
|---|---|---|---|
| 3,928,220 | 12/1975 | Slusarczuk | 148/105 |
| 4,537,624 | 8/1985 | Tenhover et al. | 75/362 |
| 4,758,267 | 7/1988 | Webb | 75/348 |

FOREIGN PATENT DOCUMENTS

| | | | |
|---|---|---|---|
| 626891 | 10/1978 | U.S.S.R. | 75/362 |

OTHER PUBLICATIONS

Nonostructured Catalysts Prepared; Joseph Haggin, C&EN, Apr. 24, 1995, p. 47.

Sonochemical Synthesis of Amorphous Iron; Kenneth S. Suslick, Nature, vol. 353, Oct. 3, 1991, pp. 414–416.

Magnetism from the Atom to the Bulk in Iron, Cobalt, and Nickel Clusters; Isabelle M. L. Billas, Science, vol. 265, Sep. 16, 1994, pp. 1682–1684.

Systhesis and Characterization of Anisometric Cobalt Nanoclusters; Charles P. Gibson, Science, vol. 267, Mar. 3, 1995, pp. 1338–1340.

The Chemistry of Ultrasound; Kenneth S. Suslick, Yearbook of Science & the Future, Encyclopedia Britannicia 1994, pp. 138–155.

Sonochemistry; Kenneth S. Suslick, Science, vol. 247, Mar. 23, 1990, pp. 1439–1445.

Sonoluminescence, Sonochemistry, and Sonophysics; L. A. Crum, J. Acoust. Soc. Am., 95(1), Jan. 1994, pp. 559–562.

Sonoluminescence; Lawrence A. Crum, Physics Today, Sep. 1994, pp. 22–29.

*Primary Examiner*—George Wyszomierski

*Attorney, Agent, or Firm*—John C. Hammar

[57] ABSTRACT

Sonochemistry permits extremely rapid cooling from the melt which is necessary for forming amorphous metals. Sonochemistry also functions at an extremely small scale to produce nanophase particles. If magnetic, these particles are valuable for magnetic recording media, manufacture of permanent magnets, and other uses. The nanophase particles agglomerate, however, which limits their utility for these magnetic applications. To keep the particles isolated, we extract the particles from the n-alkane reaction solvent in a polar solvent and cast the extracted particles with a polymer, such as polyvinylpyrrolidone.

9 Claims, No Drawings

ISOLATING NANOPHASE AMORPHOUS MAGNETIC METALS

TECHNICAL FIELD

The present invention is a method for making isolated nanophase particles of amorphous magnetic metals using sonochemistry to produce the particles, extraction to separate the particles from the reaction solvent, and a polymer to prevent them agglomerating during further processing. The invention also relates to the product obtainable by the process.

BACKGROUND ART

Kenneth Suslick of the University of Illinois pioneered research into sonochemistry, a technique that uses the energy of sound to produce cavitation bubbles in a solvent. The bubbles collapse during the compression portion of the acoustic cycle with extreme microscale energy release evidenced by high (microscale) localized temperatures and pressures, estimated at least about 5200° F. and 1800 atm, respectively. Suslick determined that sonochemistry was a way to produce amorphous metal because it provided an adequately rapid quenching of the metal from the melt, and he developed laboratory processes for making amorphous iron agglomerates desired as catalysts in hydrocarbon reforming, carbon monoxide hydrogenation, and other reactions.

Suslick also discovered that he could produce metal colloids if he sonicated the metal precursors (principally volatile metal carbonyls or other organometallics) in a polymeric ligand like polyvinylpyrrolidone or could produce nanostructured supported catalysts if sonication occurred in the presence of suspended inorganic oxide supports, such as silica or alumina.

Suslick's work has focused on catalysts which function through surface phenomena. He has not been as concerned with producing magnetic nanophase particles which have potential for significant improvements in the manufacture of magnetic recording media, permanent magnets, and other coatings and applications provided that the individual particles can be isolated from each other. The nanoparticles that Suslick produced agglomerate readily.

Suslick's work is described in the following articles that we incorporate by reference:

K. Suslick, "*Sonochemistry,*" 247 Science 1439–1445 (23 Mar. 1990);

K. Suslick et al., "*Sonochemical Synthesis of Amorphous Iron*", 353 Nature 414–416 (3 Oct. 1991); and K. Suslick, "*The Chemistry of Ultrasound,*" Yearbook of Science & the Future, Encyclopedia Britannica. Inc., 138–155 (1994).

Similar work is described in the following articles by Lawrence Crum, that we incorporate by reference:

L. Crum, "Sonoluminescence," Physics Today, Sept. 1994, pp. 22–29, and

L. Crum "*Sonoluminescence, Sonochemistry, and Sonophysics*", J. Acoust. Soc. Am. 95(1), Jan 1994, pp. 559–562.

Gibson discussed anisometric cobalt nanoclusters in his recent article in Science (vol. 267; March 3, 1995), where he produced anisometric (hexagonal disk-shaped) cobalt nanoclusters about 10) nanometers in width and 15 nanometers in thickness with oriented (001) crystals comparable to cells of α-cobalt. Gibson sonicated $Co^{2+}$ (aq) with hydrazine to produce the nanoclusters that were small enough to be strongly influenced by Brownian forces and thereby resistant to agglomeration. Working with hydrazine, however, on a commercial scale poses considerable safety questions.

SUMMARY OF THE INVENTION

The present invention is a method for making isolated nanophase, amorphous, magnetic metal particles using sonochemistry to produce the particles, extraction to separate them from the reaction liquor, and a polymer to freeze them in isolation.

The present invention also relates to the amorphous magnetic metals which are nanophase and isolated as described for magnetic recording media and other applications where agglomerated particles have reduced value.

In the present invention, we create nanophase amorphous metal particles using Suslick's sonochemistry techniques using organometallic precursors like iron pentacarbonyl in an alkane (like n-heptane or n-decane) under an inert atmosphere. Our sonic energy is input at about 20 kHz and 40–100 Watts for 1–3 hours. Thereafter, we extract the particles (about 10 nm diameter) from the alkane using a polar solvent of reasonably high vapor pressure such as $CH_3O—CH_2CH_2—OH$. Then, we add a polymer or polymeric precursors (especially those of vinylpyrrolidone, an acrylic, or a urethane) with or without surfactants to coat and separate the metal particles in a paste-like medium.

DETAILED DESCRIPTION OF A PREFERRED EMBODIMENT

By "nanophase," we mean being particles (typically spheres) of no more than about 50–100 nanometers in diameter, and, preferably, about 10 nanometers in diameter.

The present invention improves on sonochemistry by providing a simple and safe process for producing isolated nanophase, magnetic, amorphous metals, especially iron, from organometallic precursors, like $Fe(CO)_5$. These particles are useful in magnetic recording media and other coatings responsive to incident radiation. Particle size is important in these applications. Agglomeration increases the effective particle size, and agglomeration has proven to be unpredictable or irreproducible for making clusters of a common, uniform size. The agglomerated particle (i.e. the clusters) possess different physical and chemical properties in some cases, and this lack of control over the product is unacceptable. Therefore, a process that prevents agglomeration by isolating the smallest particles made with the sonochemistry conditions provides the best quality product for our intended applications.

We add the iron carbonyl or another suitable organometallic precursor or a mixture of these organometallics to a reaction flask under an inert (argon) environment in a solution of hydrocarbon, particularly an alkane, like n-heptane or n-decane. The hydrocarbon should have a reasonably high boiling point and should be inert with the organometallics. Suitable alkanes are straight and branched chain $C_6$–C12 or possibly higher. Alternatively the reaction might occur in water stabilized in hydrazine, but we prefer an alkane. Generally we follow the process descriptions of Suslick and Gibson in other respects, inputting sonic energy to the reaction mixture at about 20 kHz and 40–100 Watts for 20–360 minutes, and, preferably, for 1–3 hours.

After making the nanophase material, which is essentially all spherical metal particles of about 10 nm diameter, we depart from the prior an by extracting these particles from the reaction mixture so that we can isolate them and keep them from agglomerating in further processing.

We have discovered that the particles have a high affinity for a polar solvent, while the unreacted organometallic precursors, especially $Fe(CO)_5$, are essentially immiscible in the polar solvent. When we use heptane as the carrier solvent in the reaction mixture, we use the commercially available solvent $CH_3O—CH_2—CH_2—OH$. While we have not done complete analysis of the suitable polar solvents, we believe that other alkoxyalkyl alcohols or aliphatic polyols would be suitable extraction solvents, including ethylene glycol. We seek a nontoxic, nonhazardous solvent that has a relatively high boiling point. We believe that NMP (N-methyl-2-pyrrolidone) and the alkylene carbonates, or mixtures thereof might work, although the solubility of NMP draws it into question.

Once in the extraction solvent, we add organic matrix resins, especially urethanes, or precursors of these resins to both thicken the solution and, we believe, to coat the particles. Both mechanisms work to keep the particles electrically isolated and prevent them from agglomerating. We do not wish to be limited to either or both mechanism, however, to explain the function and character of the organic matrix resin.

The resin should be a thermoplastic.

We can add polyvinylpyrrolidone (or its precursors), polyimides, polycarbonate, methylmethacrylate, an acrylic, or polyesters.

Typical resins in the cyanate family (i.e., the urethanes) are described in U.S. Pat. No. 5,134,421, which we incorporate by reference. Cyanate resins are characterized by the reactive functionality —OCN, but we use the term to include the thio cyanate cousins —SCN as well. Cyanate resins are prepared by reacting diols or polyols with a cyanogen halide, especially cyanogen chloride or bromide. The synthesis is well known and is described in U.S. Pat. Nos. 3,448,079; 3,553,244; and 3,740,348, for example; each of which is also incorporated by reference. The cyanate functionality self-polymerizes to form cyanate esters either with or without a suitable catalyst (such as tin octoate).

We might also use linear cyanate oligomers described in U.S. patent application 08/327,942, which we incorporate by reference. Such oligomers have one, two, or four reactive functionalities (like maleic or nadic) at each end of the polymer chain for crosslinking upon curing. In these oligomers, we convert diols to dicyanates (i.e., $N{\equiv}C—O—R_4—O—C{\equiv}N$, where $R_4$ is the residue of an organic diol) in the presence of cyanogen halide and connect phenol end cap monomers or corresponding cyanate end cap monomers using the same reaction.

Suitable catalysts for the cyanate resin systems of the subject invention are well known to those skilled in the art, and include the various transition metal carboxylates and naphthenates, for example zinc octoate, tin octoate, dibutyltindilaurate, cobalt naphthenate, and the like; tertiary amines such as benzyldimethylamine and N-methylmorpholine; imidazoles such as 2-methylimidazole; acetylacetonates such as iron (III) acetylacetonate; organic peroxides such as dicumylperoxide and benzoylperoxide; free radical generators such as azobisisobutyronitrile; organophoshines and organophosphonium salts such as hexyldiphenylphosphine, triphenylphosphine, trioctylphosphine, ethyltriphenylphosphonium iodide and ethyltriphenylphosphonium bromide; and metal complexes such as copper bis[8-hydroxyquinolate]. Combinations of these and other catalysts may also be used.

Virtually any diol can be converted to the cyanate analog and used in this synthesis. For high MWs, however, we prefer to use a soluble dicyanate, especially:

$$NCO—Ø—O—Ø—SO_2—Ø—O—Ø—OCN$$

The thiocyanates exhibit essentially the same chemistry.

We thicken the resin solution by evaporating a large proportion of the extraction solvent. The product is a film, paint (or varnish), or paste useful for making catalysts and other products where small particles having large surface areas are beneficial.

While we have described preferred embodiments those skilled in the an will recognize modifications, alternatives, or variations that might be made without departing from the inventive concept. Therefore, limit the claims only as necessary in view of the pertinent prior art.

We claim:

1. A method for making nanophase, individually-isolated, metals, comprising the steps:

(a) sonicating a mixture of a metal carbonyl in an n-alkane solvent to produce an amorphous metal in the form of nanophase particles;

(b) extracting the metal from the n-alkane in an immiscible polar solvent;

(c) adding a polymer or polymeric precursors to the polar solvent-metal mixture to coat and isolate the metal particles thereby producing a polymer-metal mixture; and (d) separating the polymer-metal mixture from the polar solvent.

2. The method of claim 1 wherein the metal carbonyl is $Fe(CO)_5$.

3. The method of claim 1 wherein the n-alkane is heptane or decane.

4. The method of claim 1 wherein the polar solvent is $CH_3O—CH_2—CH_2—OH$.

5. The method of claim 1 wherein the polymer is polyvinylpyrrolidone.

6. The method of claim 1 wherein the polymer is an acrylic.

7. The method of claim 1 wherein the polymer is a urethane.

8. The method of claim 1 wherein the metal carbonyl is $Fe(CO)_5$, the n-alkane solvent is heptane or decane, the polar solvent is $CH_3O—CH_2—CH_2—OH$, the polymer is selected from the group consisting of polyvinylpyrrolidone, acrylic, and urethane, and the sonicating step involves 20 kHz at 40–100 Watts for 20–360 minutes in an inert atmosphere.

9. The method of claim 1 wherein sonicating involves inputting sound energy at 20 kHz at 40–100 W for 20–360 minutes.

* * * * *